US007046079B2

(12) United States Patent
Van Blerkom et al.

(10) Patent No.: US 7,046,079 B2
(45) Date of Patent: May 16, 2006

(54) CIRCUIT FOR GENERATING A REFERENCE VOLTAGE

(75) Inventors: Daniel Van Blerkom, Pasadena, CA (US); Meng-Chang Yang, Tainan (TW)

(73) Assignee: Sunsplus Technology Co., Ltd., Hsinchu (TW)

( * ) Notice: Subject to any disclaimer, the term of this patent is extended or adjusted under 35 U.S.C. 154(b) by 9 days.

(21) Appl. No.: 10/710,124

(22) Filed: Jun. 21, 2004

(65) Prior Publication Data

US 2005/0156660 A1 Jul. 21, 2005

(30) Foreign Application Priority Data

Jan. 19, 2004 (TW) ..... 93101321 A

(51) Int. Cl.
*G05F 1/10* (2006.01)

(52) U.S. Cl. ..... 327/543; 327/328

(58) Field of Classification Search ..... 323/312, 323/313, 314, 315, 316; 327/309, 318, 319, 327/320, 321, 325, 327, 328, 333, 534, 535, 327/537, 538, 540, 541, 543, 544, 545
See application file for complete search history.

(56) References Cited

U.S. PATENT DOCUMENTS 4,804,865 A * 2/1989 Clark, II ..... 327/541
5,672,962 A * 9/1997 Sweeney ..... 323/315
5,945,821 A * 8/1999 Sakurai et al. ..... 323/313
6,060,945 A * 5/2000 Tsay ..... 327/543
6,249,174 B1 * 6/2001 Tsunezawa ..... 327/538
6,255,886 B1 * 7/2001 Manning ..... 327/325
6,333,642 B1 * 12/2001 Kurisu ..... 326/73
6,501,303 B1 * 12/2002 Suyama ..... 327/81
6,501,467 B1 * 12/2002 Miyazaki ..... 345/210
6,774,712 B1 * 8/2004 Rhee et al. ..... 327/540
6,897,716 B1 * 5/2005 Miyazaki ..... 327/541
2003/0146991 A1 * 8/2003 Barna et al. ..... 348/302
2004/0041927 A1 * 3/2004 Cho et al. ..... 348/254
2004/0222351 A1 * 11/2004 Rossi ..... 250/208.1

* cited by examiner

*Primary Examiner*—Jeffrey Zweizig
(74) *Attorney, Agent, or Firm*—Jiang Chyun IP Office

(57) ABSTRACT

A circuit for generating a reference voltage of an image sensor is provided. The circuit comprises a signal differential amplifier, a gain amplifier, a source follower and a clamp circuit. The signal differential amplifier is adapted for receiving and comparing a bias voltage and the reference voltage, and outputting a first voltage according to a comparison result. The gain amplifier is coupled to the signal differential amplifier, and is adapted for receiving the first voltage and outputting a second voltage. The source follower, coupled to the gain amplifier, and is adapted for receiving the second voltage and outputting the reference voltage. The clamp circuit is coupled to the source follower, and is adapted for receiving the reference voltage and limiting the reference voltage to below a clamp voltage.

12 Claims, 3 Drawing Sheets

Replacement Sheet

CIRCUIT FOR GENERATING A REFERENCE VOLTAGE

CROSS REFERENCE TO RELATED APPLICATIONS

This application claims the priority benefit of Taiwan application serial no. 93101321, filed on Jan. 19, 2004.

BACKGROUND OF INVENTION

1. Field of the Invention

This invention generally relates to a circuit for generating a reference voltage, and more particularly to a circuit for generating a reference voltage of an image sensor.

2. Description of Related Art

More and more electronic devices such as mobile phones, PDA, or toys provide built-in cameras. To adapt different applications, especially for the application of mobile devices, an image sensor with low power consumption and high resolution is required. FIG. 1A is a block diagram of a traditional image sensor. Referring to FIG. 1A, the traditional image sensor includes a pixel array 110, a row driver and voltage reference generator 120, a sample and hold column circuit 130, a gain stage 140, and a pipeline A/D converter 150. The row driver and voltage reference generator 120 provides the driver signals 121 for each row, the reference voltage 122, and reference voltage VCL. Each row electrode (not shown) of the pixel array 110 receives the row driver signal 121. The pixel array 110 senses the image and then output the pixel signal 111 to each column according to the row driver signal 121. The sample and hold column circuit 130 receives, samples, and holds the pixel signal 111 of each column, and outputs the cascade pixel signal 131. The gain stage 140 receives and amplifies the cascade pixel signal 131 and generates the pixel signal 141. The A/D converter 150 generally a pipeline A/D converter, which converts the pixel signal 141 to a digital pixel signal 151 according to the reference voltage 122 for the use of the subsequent circuits (such as logic control circuit 160 or other circuits).

In the image sensor readout circuit, the process of generating reference voltage is the major power consumption of the image sensor readout circuit. Taking the sample and hold column circuit 130 of a CMOS image sensor as examples, FIG. 1B is a pixel sample circuit of a CMOS image sensor. Referring to FIG. 1B, to facilitate the illustration, the pixel 112 is used to represent the pixels 112 of the pixel array 110. Further, the pixel sample circuit 130 includes a plurality of sample/hold circuits. In FIG. 1B, only one sample/hold circuit is shown as an example. CMOS image sensor generally will sample a pixel signal voltage and a pixel reset voltage, which requires the reference voltage VCL for sampling. During the sampling period, the sense-control switches clamp and same_sig are close and sense-control switches samp_rst, cb, and col_addr are open. Hence, the voltage difference of the pixel signal voltage and the reference voltage VCL will be stored in the capacitor CS1. During the reset period, the sense-control switches clamp and same_rst are close and sense-control switches samp_sig, cb, and col_addr are open. Hence, the voltage difference of the pixel reset voltage and the reference voltage VCL will be stored in the capacitor CS2. After completing the sampling process, the sense-control switches clamp, samp_sig, and samp_rst become open and the sense-control switch cb becomes close, which is so-called the holding period. During the holding period, the pixel signal 111 of each column will be stored in one of the sample/hold circuits, and each sample/hold circuit based on the clock alternately turns on the sense-control switch col_addr (i.e., close-circuited) to output the cascade pixel signal to the gain stage 140.

In the pixel sample circuit 130, the reference voltage VCL is provided by the voltage generator 120. The voltage generator 120 also provides different reference voltages for the other circuits such as the gain stage 140 and the A/D converter 150. The reference voltage must be a stable and fix voltage. Taking the reference voltage VCL as an example, during the reset period, the right terminal of the capacitor CS2 is coupled to the reference voltage VCL and the left terminal of the capacitor CS2 is coupled to the pixel 112 to receive the reset voltage. When the reset voltage charges the capacitor CS2, the transient response of the capacitor would cause the right terminal of the capacitor CS2 to generate a pulse voltage. This pulse voltage will temporarily change the voltage level of the reference voltage VCL. The voltage generator 120 has to absorb this pulse voltage to make the VCL back to the original level. The pixel sample circuit 130 has to wait until the reference voltage VCL is back to the original level and the capacitor is stable to enter into the holding period. As the pixel array becomes larger, more and more sample/hold circuits are required, which means that the loading of the reference voltage VCL becomes larger and thus the level of the reference voltage VCL is more difficult to maintain. For example, the aforementioned pulse voltage would cause a significant change on the reference voltage level. Hence, it would take longer to go back to the original level. As the pixel array becomes larger, this effect is more significant, which causes a low sampling rate of the image sensor.

SUMMARY OF INVENTION

The present invention is directed to a circuit for generating the reference voltage of an image sensor. The clamp circuit of the circuit is adapted to make the reference voltage back to the original level and turns on the circuit when the reference voltage requires a larger driving current, otherwise the circuit is turned off. Hence, the circuit is capable of conserving the power by providing a low-power reference voltage.

According to an embodiment of the present invention, the circuit comprises a voltage follower and a clamp circuit, which are used for generating a low-power reference voltage of an image sensor.

According to an embodiment of the present invention, the circuit comprises a signal differential amplifier, a gain amplifier, a source follower and a clamp circuit. The signal differential amplifier is adapted for receiving and comparing a bias voltage and the reference voltage, and outputting a first voltage. The gain amplifier is coupled to the signal differential amplifier. The gain amplifier is adapted for receiving the first voltage and outputting a second voltage. The source follower is coupled to the gain amplifier. The source follower is adapted for receiving the second voltage and outputting the reference voltage. The clamp circuit is coupled to the source follower. The clamp circuit is adapted for receiving the reference voltage and limiting the reference voltage to below a clamp voltage. The reference voltage is provided to the image sensor for conserving the power.

In an embodiment of the present invention, the clamp circuit comprises a first diode and a second diode. An anode of the first diode is coupled to an output terminal of the source follower. An anode of the second diode is coupled to a cathode of the first diode, and a cathode of the second diode is coupled to a ground level. The clamp voltage is adapted for receiving the reference voltage.

In an embodiment of the present invention, the clamp circuit comprises a first N-type transistor and a second N-type transistor. A gate and a first source/drain of the first N-type transistor are coupled to an output terminal of the source follower. A gate and a first source/drain of the second N-type transistor are coupled to a second source/drain of the first N-type transistor, and a second source/drain of the second N-type transistor is coupled to a ground level. The clamp circuit is adapted for receiving the reference voltage.

In an embodiment of the present invention, the clamp circuit further includes a sense-control switch coupled between the second diode and the ground level.

According to an embodiment of the present invention, the circuit comprises a voltage follower and a clamp circuit. The voltage follower is adapted for receiving a bias voltage and the reference voltage and outputting the reference voltage. The clamp circuit is coupled to the voltage follower. The clamp circuit is adapted for receiving the reference voltage and limiting the reference voltage to below a clamp voltage.

In an embodiment of the present invention, the clamp circuit comprises a first diode and a second diode. An anode of the first diode is coupled to an output terminal of the voltage follower. An anode of the second diode is coupled to a cathode of the first diode, and a cathode of the second diode is coupled to a ground level. The clamp circuit receives the reference voltage.

In an embodiment of the present invention, the clamp circuit comprises a first N-type transistor and a second N-type transistor. A gate and a first source/drain of the first N-type transistor are coupled to an output terminal of the voltage follower. A gate and a first source/drain of the second N-type transistor are coupled to a second source/drain of the first N-type transistor, and a second source/drain of the second N-type transistor is coupled to a ground level. The clamp circuit receives the reference voltage.

In an embodiment of the present invention, the clamp circuit further includes a sense-control switch coupled between the second diode and the ground level.

In an embodiment of the present invention, the clamp circuit is adapted to limit the voltage level of the reference. Hence, when the change of the voltage level of the reference voltage is too huge during the circuit operation, the reference voltage can go back to the original level much faster. The clamp circuit is also used to turn on the circuit when the reference voltage requires a larger driving current, otherwise, to the circuit is turned off. Hence, the circuit is capable of conserving by providing a low-power reference voltage.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION

Figure 2:
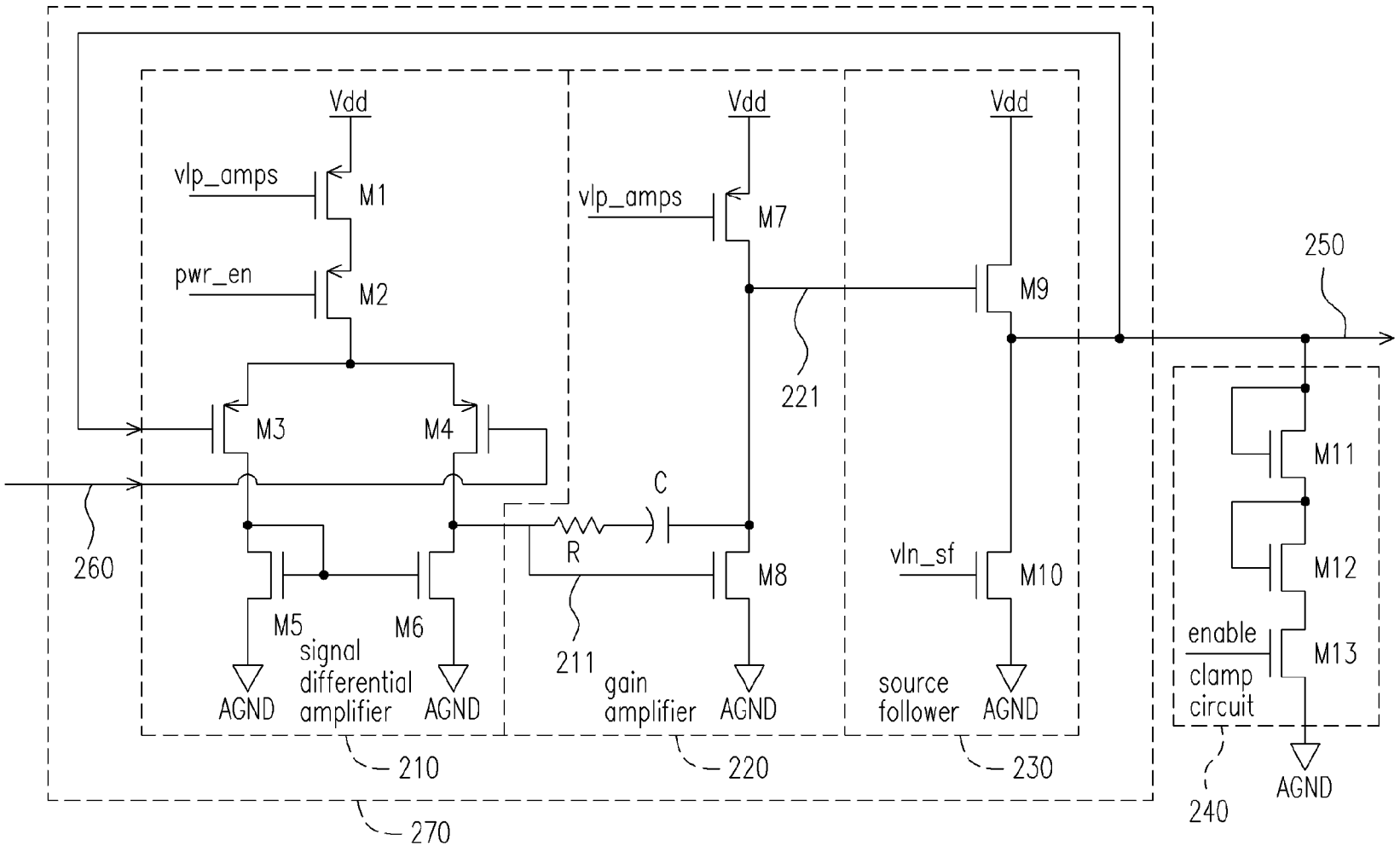
FIG. 2 is a circuit for generating reference voltage in accordance with an embodiment of the present invention.

FIG. 2 is a circuit for generating reference voltage in accordance with an embodiment of the present invention. Referring to FIG 2. the signal differential amplifier 210 receives and compares the bias voltage 260 and reference voltage 250. Then the signal differential amplifier 210 outputs the voltage 211 based on the result of the comparison. The bias voltage 260 in this embodiment is between 1.3V and 1.5V. The gain amplifier 220 is coupled to the signal differential amplifier 210. The gain amplifier 220 receives the voltage 211, and outputs the voltage 221. The source follower 230 is coupled to the gain amplifier 220. The signal differential amplifier 2l0 the gain amplifier 220 and the source follower 230 constitute a voltage follower 270 of an embodiment of the present invention. The source follower receives the voltage 221, and outputs the reference voltage 250. The clamp circuit 240 is coupled to the source follower 230. The clamp circuit receives the reference voltage 250, and limits the highest level of the reference voltage 250 based on a predetermined clamp voltage (in this embodiment the clamp voltage is 1.6V). The reference voltage 250 is outputted to the image sensor, e.g., the reference voltage VCL is used for the pixel sample circuit 130.

According to one embodiment of the present invention, the above clamp circuit 240 comprises an N-type transistor M11, an N-type transistor M12, and an N-type transistor M13. The gate and the drain of the N-type transistor M11 are coupled to the reference voltage 250. The drain and gate of the N-type transistor M12 are coupled to the source of the N-type transistor M11. The drain of the N-type transistor M13 is coupled to the source of the N-type transistor M12. The source of the N-type transistor M13 is coupled to the ground level AGND. The gate of the N-type transistor M13 is coupled to the enable signal enable. This embodiment can enable or disable the clamp circuit 240 by controlling the N-type transistor M13. When the clamp circuit 240 is enabled or turned on when the reference voltage requires a large driver current. Otherwise the clamp circuit 240 will be turned off so that unnecessary power consumption can be avoided. The N-type transistor M13 can be replaced by other suitable types of switches in order to achieve the purpose of the present invention. In one embodiment of the present invention, the N-type transistor M12 can be directly coupled to the ground level AGND and the N-type transistor M13 can be omitted. Further, the N-type transistors M11 and M12 can also be replaced by using two cascade diodes (not shown) in order to achieve the purpose of the present invention. Although this embodiment uses N-type transistors or diodes to construct the clamp circuit 240, the other equivalent circuits capable of performing the clamp function may also be used to achieve the purpose of the present invention and therefore such an embodiment falls within the scope of the present invention.

According to one embodiment of the present invention, the above signal differential amplifier 210 comprises 5 P-type transistors M1–M4 and two N-type transistors M5–M6. The source of the P-type transistors M1 is coupled to the system voltage Vdd. The gate of the transistor M1 is coupled to the control signal vlp_amps. The source of the P-type transistors M2 is coupled to the drain of the transistor M1. The gate of the transistor M2 is coupled to the control signal pwr_en. The drain of the transistor M2 is coupled to the source of the transistor M3 and the source of the transistor M4. The transistor M2 can cut off the power when the signal differential amplifier 210 is in off state to save power. The gate of the P-type transistors M3 is coupled to the reference voltage 250. The gate of the P-type transistors M4 is coupled to the bias voltage 260. The NMOS current source formed by the N-type transistors M5 and M6 can be deemed as the active load of the signal differential amplifier 210. The drain of the transistor M5 is coupled to the gate of the transistor M5, the gate of the transistor M6, and the drain of the transistor M3. The source of the transistor M5 is coupled to the ground level AGND. The source of the transistor M6 is coupled to the ground level AGND. The drain of the transistor M6 is coupled to the drain of the transistor M4. The signal differential amplifier 210 outputs the voltage 211.

According to one embodiment of the present invention, the above gain amplifier 220 comprises a P-type transistor M7, a N-type transistor M8, a capacitor C, and a resistor R. The source of the transistor M7 is coupled to the system voltage Vdd. The gate of the transistor M7 is coupled to the control signal vlp_amps. One terminal of the resistor R is coupled to the voltage 211 and the gate of the transistor M8. The other terminal of the resistor R is coupled to one terminal of the capacitor C. In this embodiment the resistance of the resistor R is 5 Kohm; and the capacitance of the capacitor is 2 pF. The source of the transistor M8 is coupled to the ground level AGND. The drain of the transistor M8 is coupled to the drain of the transistor M7 and the other terminal of the capacitor C. The gain amplifier 220 outputs the voltage 221.

According to one embodiment of the present invention, the above source follower 230 comprises two N-type transistors M9 and M10. The gate of the transistor M9 is coupled to the voltage 221. The drain of the transistor M9 is coupled to the system voltage Vdd. The gate of the transistor M10 is coupled to the control signal vln_sf. The source of the transistor M10 is coupled to the ground level AGND. The drain of the transistor M10 is coupled to the source of the transistor M9 and outputs the reference voltage 250.

Figure 1A:
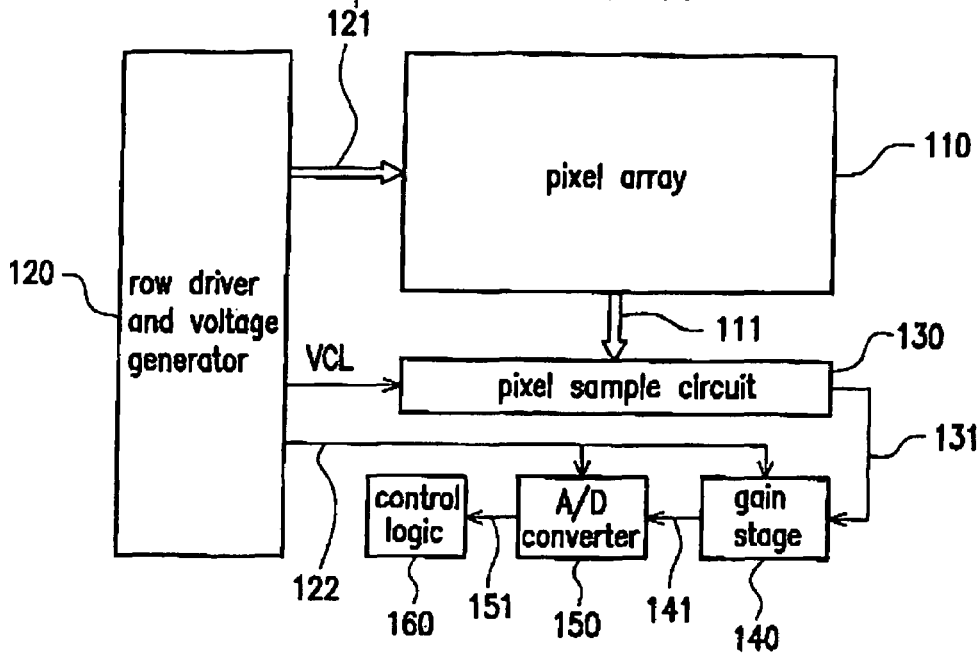
FIG. 1A(PRIOR ART)
FIG. 1A is a block diagram of a traditional image sensor.
Figure 1B:
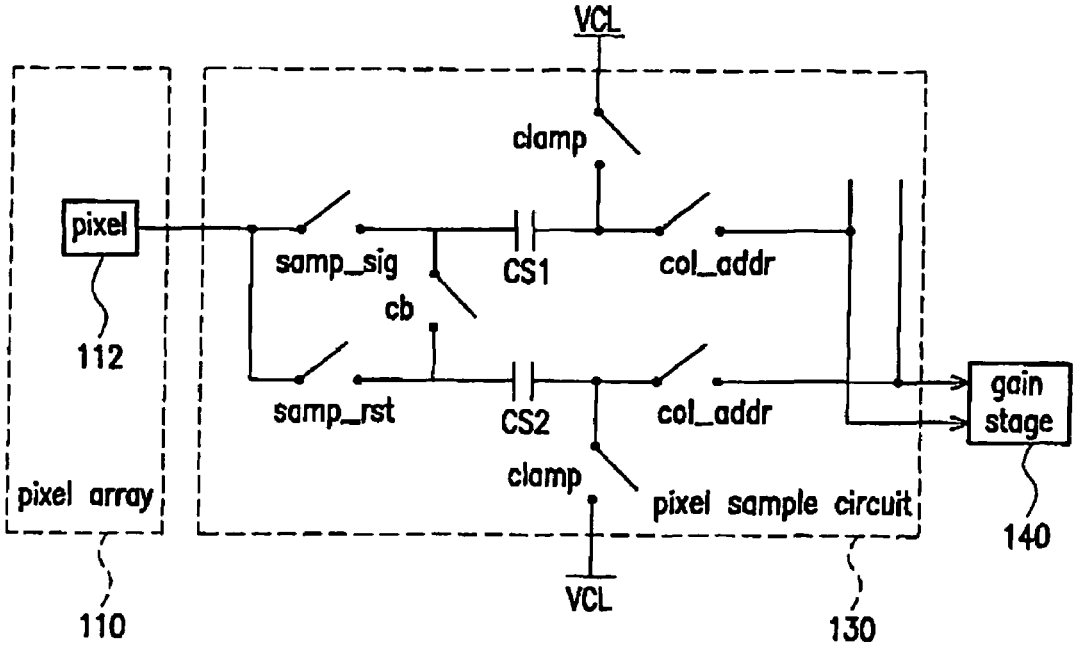
FIG. 1B(PRIOR ART)
FIG. 1B is a pixel sample circuit of a CMOS image sensor.
Figure 3:
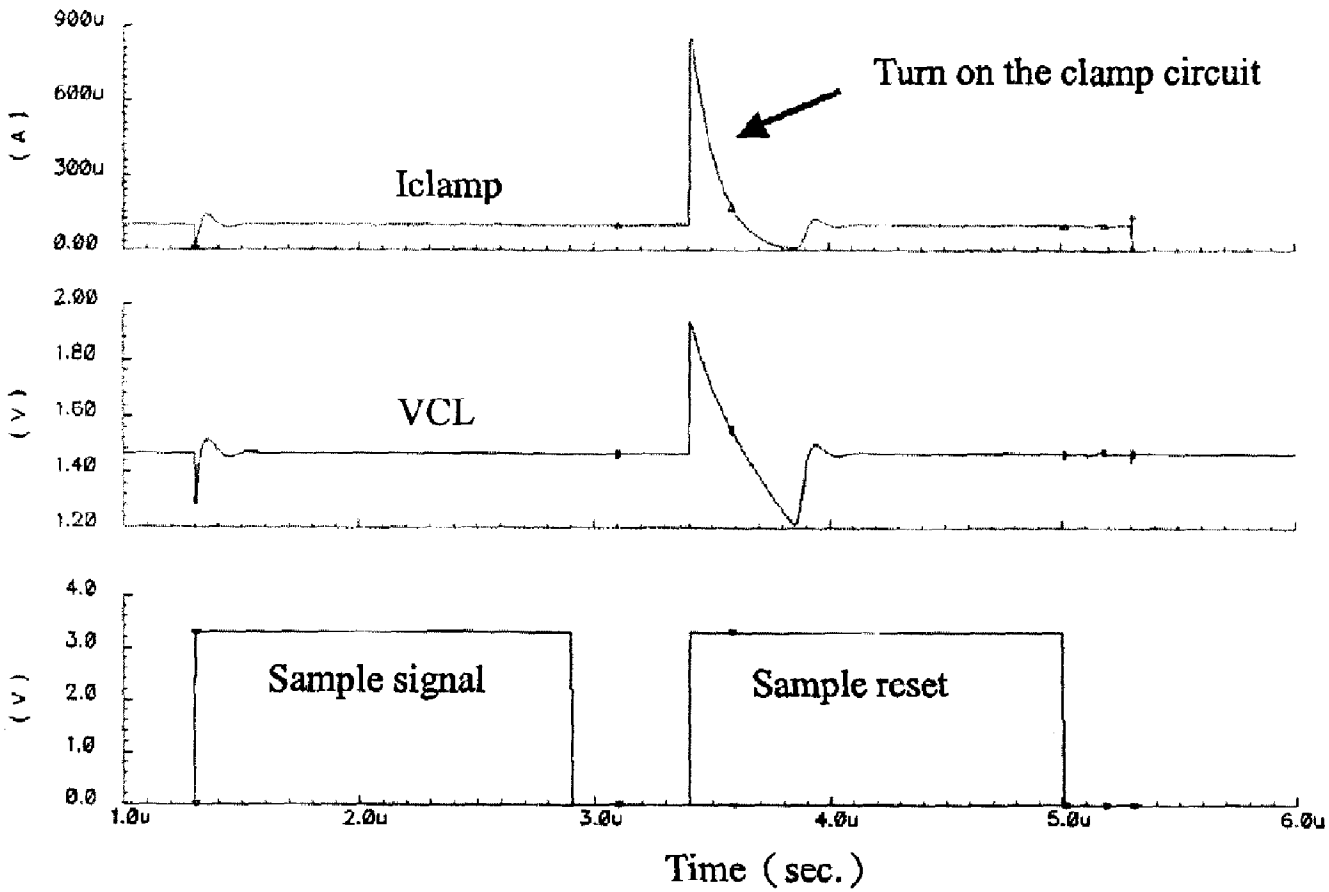
FIG. 3 is a simulated timing sequence of the reference voltage in accordance with an embodiment of the present invention.

For the purpose of illustrating the present invention, a reference voltage VCL shown in FIG. 1A is used as an example. FIG. 3 is a simulated timing sequence of the reference voltage in accordance an embodiment of the present invention. Referring to FIGS. 1B, 2 and 3, the two rectangles in FIG. 3 represent sampling of the pixel voltage and sampling of the reset voltage respectively, which also means the sampling period and the resetting period of FIG. 1B. The aforementioned two periods correspond to relationship of the reference voltage VCL (e.g., the reference voltage 250 in FIG. 2) and the time (or the current Iclamp of the reference voltage VCL vs. Time at the top of FIG. 3). As shown, at the beginning of the sampling period because the transient response of the capacitor CS1 causes the reference voltage to generate a negative pulse, the transistor M10 is in off state and the transistor M9 provides the required current so that the reference voltage VCL can quickly go back to the original level. At the beginning of the resetting period, because the transient response of the capacitor CS2 causes the reference voltage to generate a positive pulse, the transistor M9 is in off state and the transistor M10 absorbs the current due to the positive pulse so that the reference voltage VCL can quickly go back to the original level. For the sake of power saving, traditionally the transistor M10 has a small driving current so that VCL would take longer to go back to the original level, which is the drawback of the traditional design. This embodiment uses the clamp circuit 240 to limit the reference voltage 250. When the reference voltage generates a positive pulse, the clamp circuit 240 will turn on the current flow to absorb the current of the positive pulse (at the same time the transistor M13 is on) so that the reference voltage VCL can go back to the original level quickly. In FIG. 3, the time t represents the settle time counted from the time the reference voltage VCL generates the positive pulse to the time the reference voltage VCL goes back to the stable level (less than 1 mV from the original level). According to the simulation result, the settle time is around 1.6 microsecond. In this embodiment the clamp circuit 240 uses 2 serially connected N-type transistors, which provides a 1.6V voltage drop. The number of the stages for serial connection depends on the requirement and shall fall within the scope of the present invention.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

The invention claimed is:

1. A circuit for generating a reference voltage of an image sensor, comprising:

a signal differential amplifier, for receiving and comparing a bias voltage and said reference voltage, and outputting a first voltage according to a comparison result;

a gain amplifier, coupled to said signal differential amplifier, for receiving said first voltage and outputting a second voltage;

a source follower, coupled to said gain amplifier, for receiving said second voltage and outputting said reference voltage; and a clamp circuit, coupled to said source follower, for receiving said reference voltage and limiting said reference voltage to below a clamp voltage.

2. The circuit of claim 1, wherein said clamp circuit includes:

a first diode, having an anode of said first diode being coupled to an output terminal of said source follower; and a second diode, having an anode of said second diode being coupled to a cathode of said first diode, and a cathode of said second diode being coupled to a ground level.

3. The circuit of claim 2, wherein said clamp circuit further includes a sense control switch coupled between said second diode and said ground level.

4. The circuit of claim 1, wherein said clamp circuit includes:

a first N-type transistor, having a gate and a first source/drain of said first N-type transistor being coupled to an output terminal of said source follower; and a second N-type transistor, having a gate and a first source/drain of said second N-type transistor being coupled to a second source/drain of said first N-type transistor, and a second source/drain of said second N-type transistor being coupled to a ground level.

5. The circuit of claim 4, wherein said clamp circuit further includes a sense control switch coupled between said second N-type transistor and said ground level.

6. The circuit of claim 1, wherein said image sensor is a CMOS image sensor.

7. A circuit for generating a reference voltage of an image sensor, comprising:

a voltage follower, for receiving a bias voltage and a first reference voltage and outputting a second reference voltage as the reference voltage generated by the circuit; and a clamp circuit coupled to said voltage follower, for receiving said second reference voltage, for receiving an enable signal and to alternatively limit said second reference voltage to below a clamp voltage under control of the enable signal.

8. The circuit of claim 7, wherein said clamp circuit includes:

a first diode, having an anode of said first diode being coupled to an output terminal of said voltage follower; and a second diode, having an anode of said second diode being coupled to a cathode of said first diode, and a cathode of said second diode being coupled to a ground level.

9. The circuit of claim 8, wherein said clamp circuit further includes a sense-control switch coupled between said second diode and said ground level.

10. The circuit of claim 7, wherein said clamp circuit includes:

a first N-type transistor, having a gate and a first source/drain of said first N-type transistor being coupled to an output terminal of said voltage follower; and a second N-type transistor, having a gate and a first source/drain of said second N-type transistor being coupled to a second source/drain of said first N-type transistor, and a second source/drain of said second N-type transistor being coupled to a ground level.

11. The circuit of claim 10, wherein said clamp circuit further includes a sense-control switch coupled between said second N-type transistor and said ground level.

12. A circuit comnrising:

a voltage follower, for receiving a bias voltage and a first reference voltage and outputting a second reference voltage as a reference voltage generated by the circuit for a CMOS image sensor; and a clamp circuit, coupled to said voltaire follower, for receiving said second reference voltage, for receiving an enable signal and to alternatively limit said second reference voltage to below a clamp voltage under control of the enable signal.

* * * * *

UNITED STATES PATENT AND TRADEMARK OFFICE

CERTIFICATE OF CORRECTION

PATENT NO. : 7,046,079 B2
APPLICATION NO. : 10/710124
DATED : May 16, 2006
INVENTOR(S) : Van Blerkom et al.

It is certified that error appears in the above-identified patent and that said Letters Patent is hereby corrected as shown below:

On title page item (73) Assignee: Sunplus Technology Co., Ltd.,
Hsinchu (TW)

Signed and Sealed this

Twelfth Day of December, 2006

JON W. DUDAS
*Director of the United States Patent and Trademark Office*